US010465679B2

(12) United States Patent
Hansen

(10) Patent No.: US 10,465,679 B2
(45) Date of Patent: Nov. 5, 2019

(54) ELECTRIC MOTOR DRIVEN PUMP

(71) Applicant: Eaton Intelligent Power Limited, Dublin (IE)

(72) Inventor: Nicholas John Hansen, Jackson, MS (US)

(73) Assignee: Eaton Intelligent Power Limited, Dublin (IE)

( * ) Notice: Subject to any disclaimer, the term of this patent is extended or adjusted under 35 U.S.C. 154(b) by 437 days.

(21) Appl. No.: 15/028,641

(22) PCT Filed: Oct. 10, 2014

(86) PCT No.: PCT/US2014/060059
§ 371 (c)(1),
(2) Date: Apr. 11, 2016

(87) PCT Pub. No.: WO2015/054588
PCT Pub. Date: Apr. 16, 2015

(65) Prior Publication Data

US 2016/0252089 A1 Sep. 1, 2016

Related U.S. Application Data

(60) Provisional application No. 61/889,668, filed on Oct. 11, 2013.

(51) Int. Cl.

| | |
|---|---|
| ***F04B 53/08*** | (2006.01) |
| ***F04B 1/14*** | (2006.01) |
| ***F04B 17/03*** | (2006.01) |
| ***F04B 23/10*** | (2006.01) |
| ***F04B 53/04*** | (2006.01) |

(Continued)

(52) U.S. Cl.
CPC ..... *F04B 53/08* (2013.01); *F04B 1/14* (2013.01); *F04B 1/145* (2013.01); *F04B 17/03* (2013.01); *F04B 23/106* (2013.01); *F04B 53/04* (2013.01); *F04C 11/008* (2013.01); *F04C 15/008* (2013.01)

(58) Field of Classification Search
CPC ..... F04B 17/03; F04B 23/106; F04B 53/08; F04B 1/128; F04B 1/2064; F04B 1/145; F04C 11/008; H02K 5/12; H02K 5/18; H02K 5/20; H02K 9/00; H02K 9/19
See application file for complete search history.

(56) References Cited

U.S. PATENT DOCUMENTS

| | | | | |
|---|---|---|---|---|
| 3,525,001 A * | 8/1970 | Erickson | H02K 9/19 310/54 |
| 3,672,793 A * | 6/1972 | Yowell | F04B 1/128 417/203 |
| 5,220,225 A | 6/1993 | Moon, Jr. | |

(Continued)

OTHER PUBLICATIONS

International Search Report for corresponding International Patent Application No. PCT/US2014/060059 dated May 19, 2015.

*Primary Examiner* — Kenneth J Hansen
(74) *Attorney, Agent, or Firm* — Merchant & Gould P.C.

(57) ABSTRACT

An electric motor driven pump assembly configuration that includes an electric motor, a hydraulic pump driven by the electric motor is provided. The hydraulic pump is driven by the electric motor to convert electrical power into hydraulic power. A multi-inlet hydraulic pump enhances cooling flow through a pump case of the assembly and also enhances cooling flow for cooling the electric motor and corresponding drive/control components.

12 Claims, 11 Drawing Sheets

(51) Int. Cl.
*F04C 11/00* (2006.01)
*F04C 15/00* (2006.01)

(56) References Cited

U.S. PATENT DOCUMENTS 5,354,182 A 10/1994 Niemiec et al.
6,201,365 B1 * 3/2001 Hara ..... B60K 6/26
310/54

* cited by examiner

ELECTRIC MOTOR DRIVEN PUMP

CROSS-REFERENCE TO RELATED APPLICATION(S)

This application is a National Stage Application of PCT/US2014/060059, filed on Oct. 10, 2014, which claims benefit of U.S. patent application Ser. No. 61/889,668 filed on Oct. 11, 2013, and which applications are incorporated herein by reference. To the extent appropriate, a claim of priority is made to each of the above disclosed applications.

TECHNICAL FIELD

The present disclosure relates generally to electric motor driven pumps and, more specifically, axial driven axial piston pumps.

BACKGROUND

Hydraulic control systems typically convert rotating mechanical power into hydraulic fluid power. Hydraulic control systems typically include hydraulic pumps that convert mechanical energy (e.g., torque from a power source such as an electric motor or an engine). One common type of hydraulic pump is an axial piston pump. Axial-piston pumps are often used to power the hydraulic systems of jet aircrafts. An axial-piston pump is a positive displacement pump having a rotating group that includes a number of piston-shoe assemblies arranged in a circular array, powered around a drive shaft, within a piston block. The rotating group can be enclosed within a pump casing containing hydraulic fluid. The pump can be cooled by providing a controlled flow of hydraulic fluid through the pump case. Typically, hydraulic flow into the pump case can be provided by normal leakage from the rotating group of the pump and other leakage sources. Pump cases typically also have case drain ports for allowed hydraulic fluid to exit the pump cases and flow to a system reservoir.

SUMMARY

Teachings of the present disclosure relate to an electric motor driven pump assembly. The pump assembly can be configured to scavenge power from the electric motor to enhance the flow hydraulic fluid (e.g., hydraulic oil) to provide cooling of the pump assembly and the electric motor. In certain examples, the electric motor is controlled and powered via a digital electronic controller, and the pump assembly provides hydraulic fluid cooling flow for cooling the digital electronic controller and other electrical components associated with the electric motor. In certain examples, cooling fluid is enhanced by a pump having multiple inlets with one inlet in fluid communication with an interior of a pump case of the pump assembly and another inlet in fluid communication with a cooling loop for cooling the electric motor and the electronic controller. In certain examples, the pump has a single outlet. In certain examples, the single outlet is in fluid communication with a case drain port of the pump casing. In certain examples, the pump is a vane pump having a rotor that rotates with an output shaft of the electric motor. In certain examples, a main pump is also driven by the output shaft and is housed within the pump casing along with the vane pump. Aspects of the present disclosure allow the electric motor pump to be effectively cooled while minimizing, size, weight and cost.

In certain examples, the electric motor may be a digitally controlled electric motor. Hydraulic fluid flow for cooling can be provided to the hydraulic pump case, electric motor, and digital controller to provide enhanced reliability. Separating dual inlet lobes into two distinct vane pump inlets enables a single scavenge pump to provide both functions. This eliminates the need to have two separate scavenge pumps, subsequently reduces the overall weight and cost and improves reliability due to reduction of parts and complexity. The mass flow rate needed for each cooling path may not be identical; but can be. In certain examples, the displacement for each vane pump inlet can be set independently to provide a customized flow rate for each cooling path from a single scavenge pump.

In one example, the hydraulic pump can be a ten vane, dual lobe vane unit, having a side discharge (single outlet) and a case drain flow out provided by combination of two discharge lobes. The hydraulic pump can also include separated dual inlets, having a pump case scavenge function provided by one lobe and a cooling-loop scavenge function provided by the other lobe. Of course, outer styles of pumps having multiple inlets are also contemplated.

Aspects of the present disclosure relate to improving overall cooling efficiency of an electric motor pump system. For example, since the electric motor circuitry and a main hydraulic pump preferably are cooled, a hydraulic vane pump disposed in tandem along an axis of rotation and interconnected by a common shaft may be configured to move the cooling fluid through both the electric motor circuitry and a hydraulic pump. Aspects of the present disclosure relate to efficient design of a vane pump assembly within the electric motor driven pump assembly. Since the vane pump assembly is configured to enhance cooling flow to both the electric motor circuitry undo main hydraulic pump, the vane pump can be configured to have multiple inlets. In some examples, one of the inlets is configured to draw hydraulic fluid from within the pump casing and one draws fluid through a cooling loop for cooling the electric motor and corresponding components. As a result, the dual inlet vane pump is designed to scavenge cooling flow for cooling an electric motor with drive electronics and also for cooling the main hydraulic pump case utilizing the case flow.

Teachings of the present disclosure provide an improved operating system for the electric motor driven pump assembly by which overheating of the main hydraulic pump may be prevented; which includes reducing pump size requirements and decreasing weight size reduction of the pump assembly. A further teaching of the disclosure is to provide an improved hydraulic system by which each of the above objects may be accomplished; which will require a minimum of additional apparatus; and which will be compact, dependable, simple and inexpensive.

A variety of additional aspects will be set forth in the description that follows. The aspects can relate to individual features and to combinations of features. It is to be understood that both the forgoing general description and the following detailed description are exemplary and explanatory only and are not restrictive of the broad concepts upon which the examples disclosed herein are based.

BRIEF DESCRIPTION OF THE DRAWINGS

The accompanying drawings, which are incorporated in and constitute a part of this disclosure, illustrate various examples of the present disclosure. In the drawings.

DETAILED DESCRIPTION

An electric motor driven pump assembly in accordance with the principles of the present disclosure can incorporates a digitally controlled electric motor designed to drive a hydraulic pump to convert electrical power to hydraulic power. The assembly can include a cooling system for circulating hydraulic fluid within a flow loop from a reservoir through a motor casing containing the electric motor and related control components. The cooling system can also circulate hydraulic fluid through a pump casing of the assembly. In certain examples, a multiple inlet pump (e.g., a dual inlet pump) is used to enhance cooling flow. The pump can outlet the cooling flow to a reservoir or the system. One or more filters can be provided for filtering the hydraulic fluid before it enters the reservoir or elsewhere in the system.

Figure 1:
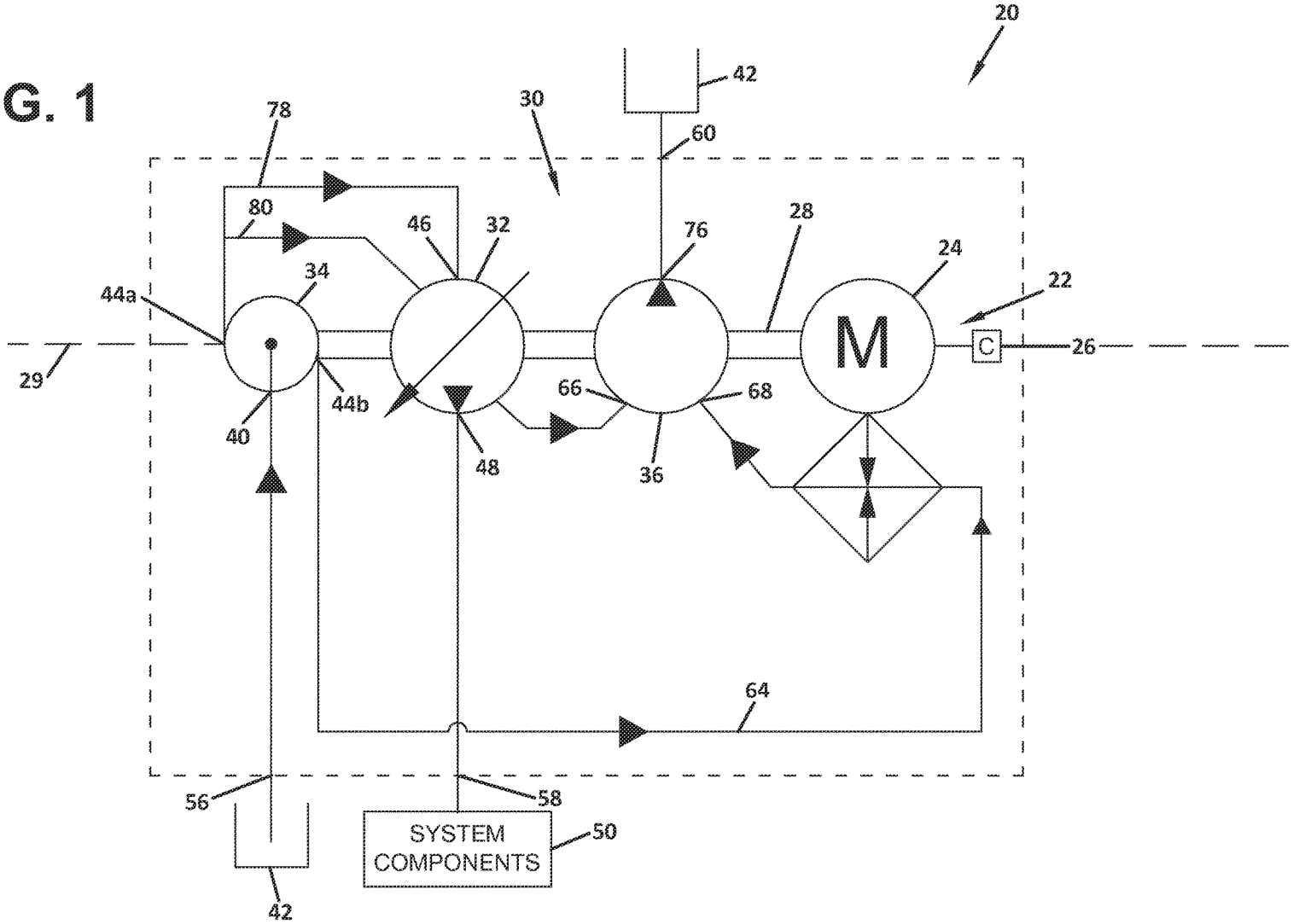
FIG. 1 is a schematic depiction of an electric motor driven pump arrangement in accordance with the principles of the present disclosure.
Figure 2:
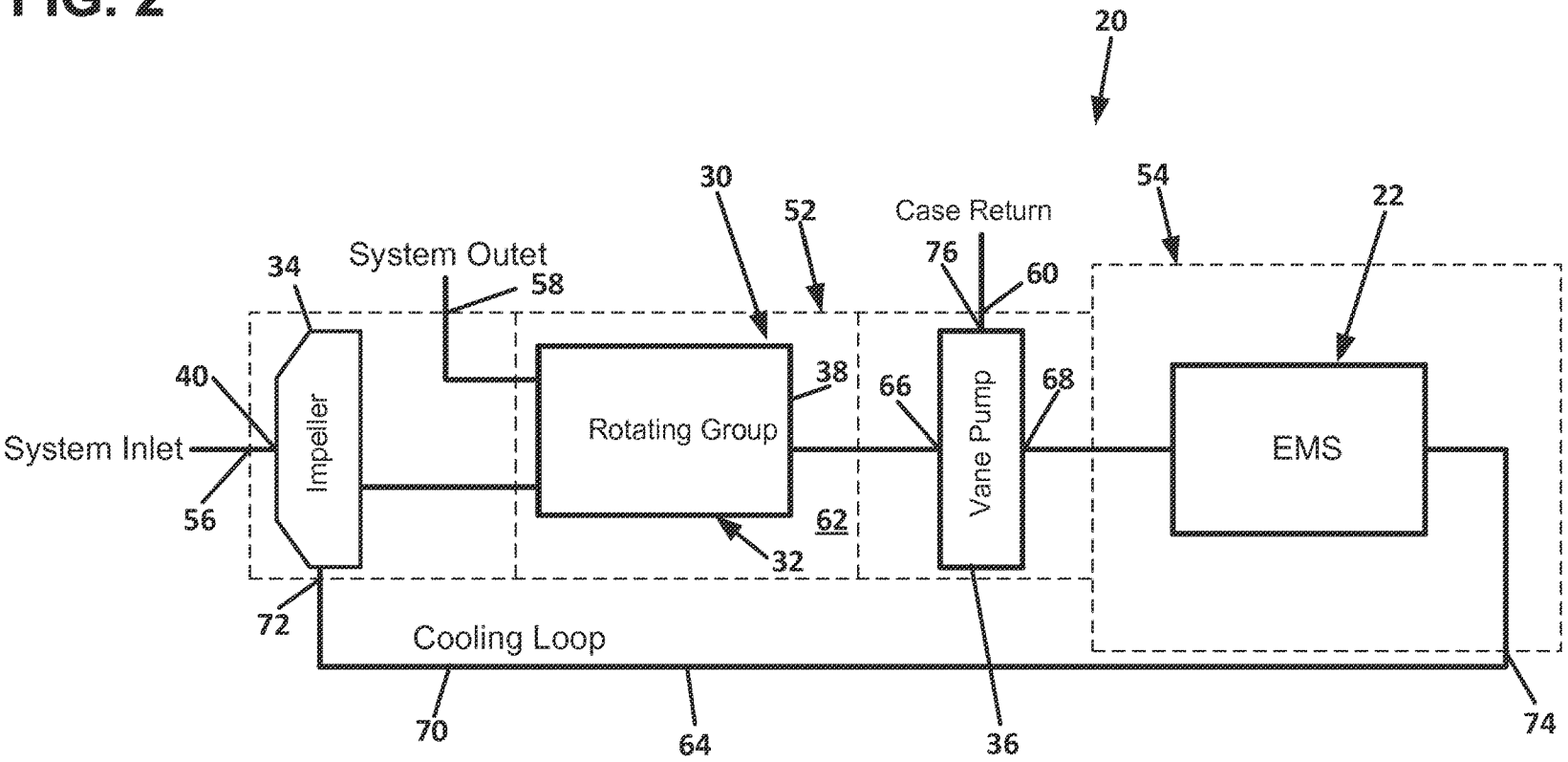
FIG. 2 is a schematic block-style diagram of the electric motor driven pump arrangement of FIG. 1.

FIGS. 1 and 2 illustrate an electric motor pump arrangement 20 in accordance with the principles of the present disclosure. Electric motor pump arrangement 20 includes an electric motor system 22 having an electric motor 24 and an integrated control arrangement 26. The electric motor 24 of the electric motor system 22 drives rotation of an output shaft 28 about an axis of rotation 29. The electric motor pump arrangement 20 also includes a pump assembly 30 including a plurality of pumps powered by rotation of the output shaft 28 by torque provided by the electric motor 24. The plurality of pumps can be positioned along the axis of rotation 29 and can be coupled to the output shaft 28. In one example, the plurality of pumps of the pump assembly 30 can include a main hydraulic pump 32, a suction boost pump 34 and a cooling flow pump 36. The main hydraulic pump 32 can include a rotating group 38 configured to be rotated about the axis of rotation 29 by the output shaft 28. The suction boost pump 34 has an inlet 40 in fluid communication with tank 42 (the system reservoir) and a first outlet 44*a* in fluid communication with an inlet 46 of the main hydraulic pump 32. The main hydraulic pump 32 also includes an outlet 48 in fluid communication with driven system components 50 of a corresponding hydraulic system intended to be powered by the electric to motor pump arrangement 20. Thus, the main hydraulic pump 32 provides system pressure and flow for meeting the power demands of the system components 50.

The cooling flow pump 36 can be referred to as a scavenge pump because it scavenges energy from the output shaft 28. In certain embodiments, the cooling flow pump 36 is configured to boost or enhance cooling flow through the electric motor pump arrangement 20. For example, the cooling flow pump 36 can be configured to boost or enhance the flow of hydraulic fluid used to cool the pump assembly 30 and also can be used to boost or enhance the flow of hydraulic fluid for cooling the electric motor system 22.

Referring to FIG. 2, the pump assembly 30 can be housed within a pump case 52 and the electric motor system 22 can be housed within a motor case 54. The pump case 52 can include an inlet port 56 in fluid communication with the inlet 40 of the suction boost pump 34 for allowing the suction boost pump 34 to be coupled to tank 42. The pump case 52 can also include an outlet port 58 in fluid communication with the outlet 48 of the main hydraulic pump 32 for allowing the outlet 48 to be coupled to the system components 50. The pump case 52 further can include a case drain port 60 in fluid communication with an interior 62 of the pump case 52 for allowing hydraulic fluid to be drained and/or pumped from the pump case 52. In certain examples, the cooling flow pump 36 is configured to scavenge energy from the output shaft 28 for use in enhancing or boosting cooling flow through the interior 62 of the pump case 52 and also through a cooling loop 64 that extends through the motor case 54. The cooling loop 64 or a portion of the cooling loop can also be referred to as a cooling flow path or a cooling flow route.

In certain examples, the cooling flow pump 36 can have a multiple inlet configuration. For example, the cooling flow pump 36 can include a first inlet 66 for drawing hydraulic fluid from the interior 62 of the pump case 52, and a second inlet 68 for drawing hydraulic fluid from the cooling loop 64 that passes through the motor case 54. As shown at FIGS. 1 and 2, hydraulic fluid flow is introduced into the cooling loop 64 from the suction boost pump 34 which provides pressure and flow for moving the hydraulic fluid through the cooling loop 64. In certain examples, a portion of the cooling loop 64 extending from the suction boost pump 34 to the motor case 54 can extend outside of the pump case 52 and the motor case 54 see section 70 of the cooling loop 64). By providing the section 70 of the cooling loop 64 outside of the pump case 52 and the motor case 54, additional components (e.g., heat exchangers for providing further cooling of the hydraulic fluid or other structures), can be more easily added to the overall system to satisfy future system demands. In certain examples, section 70 includes a tube (e.g., a hose) coupled between an outlet port 72 on the pump case 52 and an inlet port 74 on the motor case 54.

As depicted at FIG. 2, the cooling flow pump 36 has a single output 76 in fluid communication with the case drain port 60. In this way, hydraulic fluid drawn from the interior 62 of the pump case 52 and from the cooling loop 64 can be combined and directed out of the pump case 52 to tank 42.

Referring again to FIG. 1, the suction boost pump 34 can include a first outlet 44*a* positioned 180 degrees out of phase with respect to a second outlet 44*b*. The first outlet 44*a* can provide hydraulic fluid at a boost pressure level to the inlet 46 of the main hydraulic pump 32. The first outlet 44*a* can also provide hydraulic fluid at boost pressure into the interior 62 of the pump case 52. Hydraulic fluid flow to the inlet 46 of the main hydraulic pump 32 can be provided through line 78 and hydraulic fluid flow to the interior 62 of the pump case 52 can be provided through line 80. The outlet 44*b* is in fluid communication with the cooling loop 64 and pumps hydraulic fluid through the cooling loop 64. Other arrangements for the outlets 44*a*, 44*b* can also be used (e.g., other phase angles could be used or flow could be branched from a single outlet to the inlet 46, the pump case 52 and the cooling loop 64).

It will be appreciated that the cooling flow pump 36 is configured to provide enhanced hydraulic fluid flow through the pump case 62 to provide effective cooling of the various components within the pump case 52. It will be appreciated that hydraulic fluid flow to the interior 62 of the pump case 52 can be provided by normal leakage from the various components and rotating groups of the pump assembly 30. Additionally, as described above, hydraulic fluid flow can also be provided to the interior 62 of the pump case 52 from the suction boost pump 34. It will be appreciated that the cooling flow pump 36 is designed and/or sized so that the maximum inlet flow through the first inlet 66 is less than the anticipated flow into the pump case 52 due to hydraulic fluid leakage plus make-up flow provided by the suction boost pump 34. in this way, the cooling flow pump 36 is prevented from cavitating.

Figure 3:
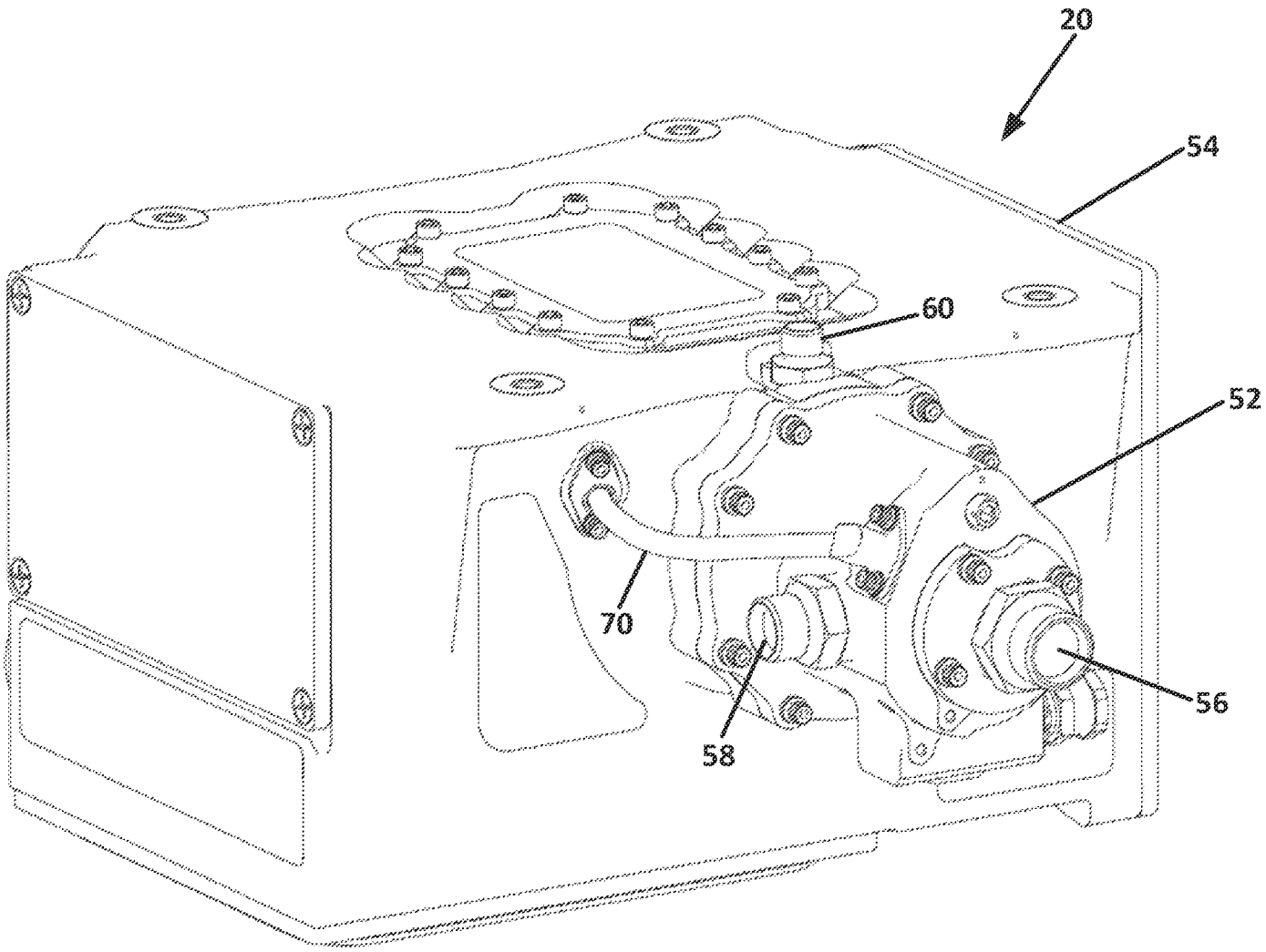
FIG. 3 is a perspective view illustrating an example configuration for the electric motor driven pump arrangement of FIGS. 1 and 2.

FIG. 3 shows the electric motor pump arrangement 20 with the pump case 52 secured to the motor case 54. In certain examples, pump case 52 can be fastened with fasteners (e.g., bolts) to the pump case 52. As shown at FIG. 3, the inlet port 56 and the outlet port 58 for the main hydraulic pump 32 are accessible on the exterior of the pump case 52. Additionally, the section 70 of the cooling loop 64 that is positioned outside the pump case 52 is shown routed from the outlet port 72 to the inlet port 74.

In certain examples, the electric motor 24 of the electric motor system 22 includes a brushless motor. In certain examples, the control arrangement 26 is a digital controller that powers and controls operation of the electric motor 24. In certain examples, the cooling loop 64 can be configured to draw heat away from the electric motor 24 as well as the control arrangement 26. In certain examples, the cooling loop 64 is routed from the pump case 52, through the motor case 54, back into the pump case 52 to the cooling flow pump 36 and then out the pump case 52 through the case drain port 60.

Figure 4:
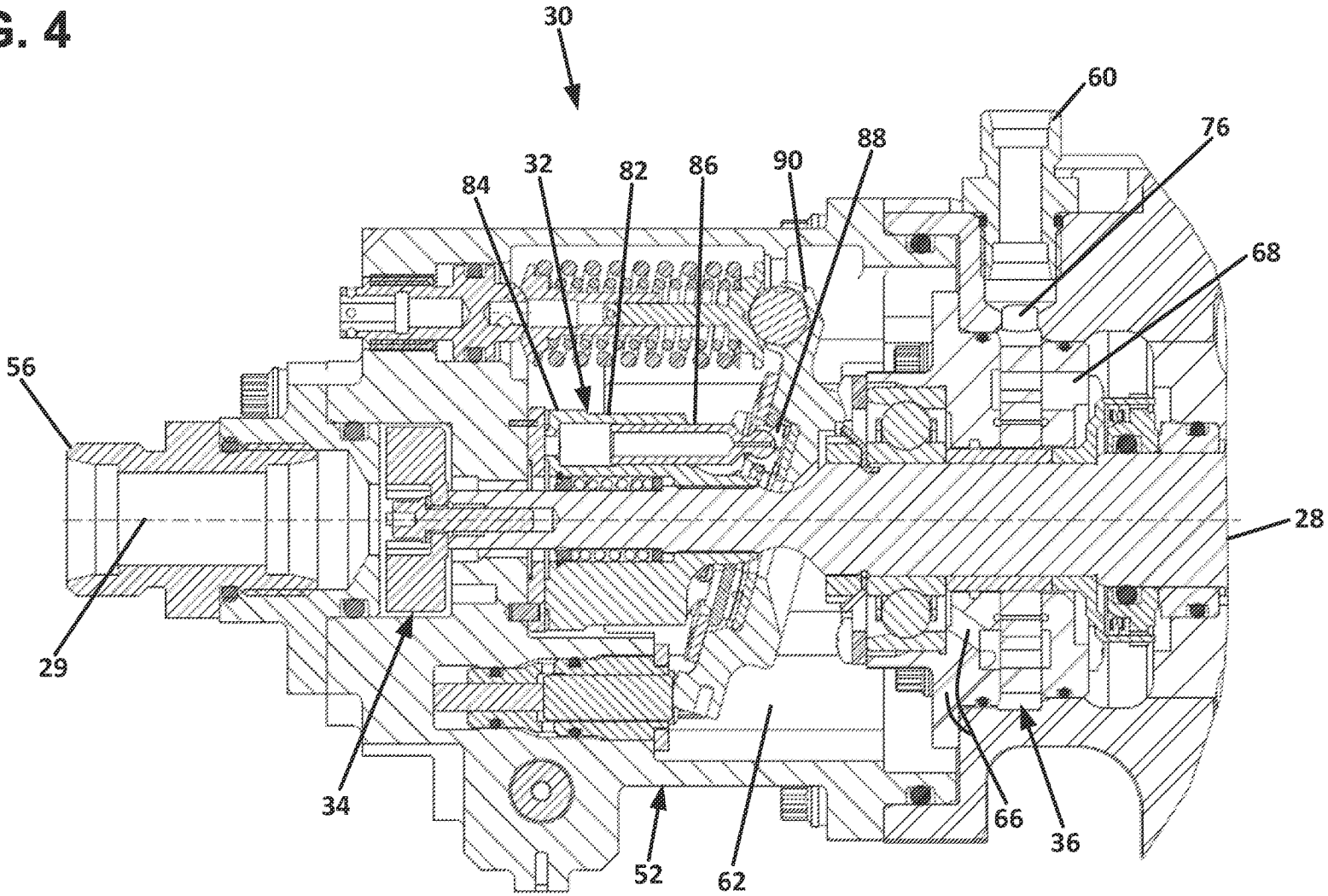
FIG. 4 is a cross-sectional view through a pump assembly of the electric motor driven pump arrangement of FIG. 3.
Figure 5:
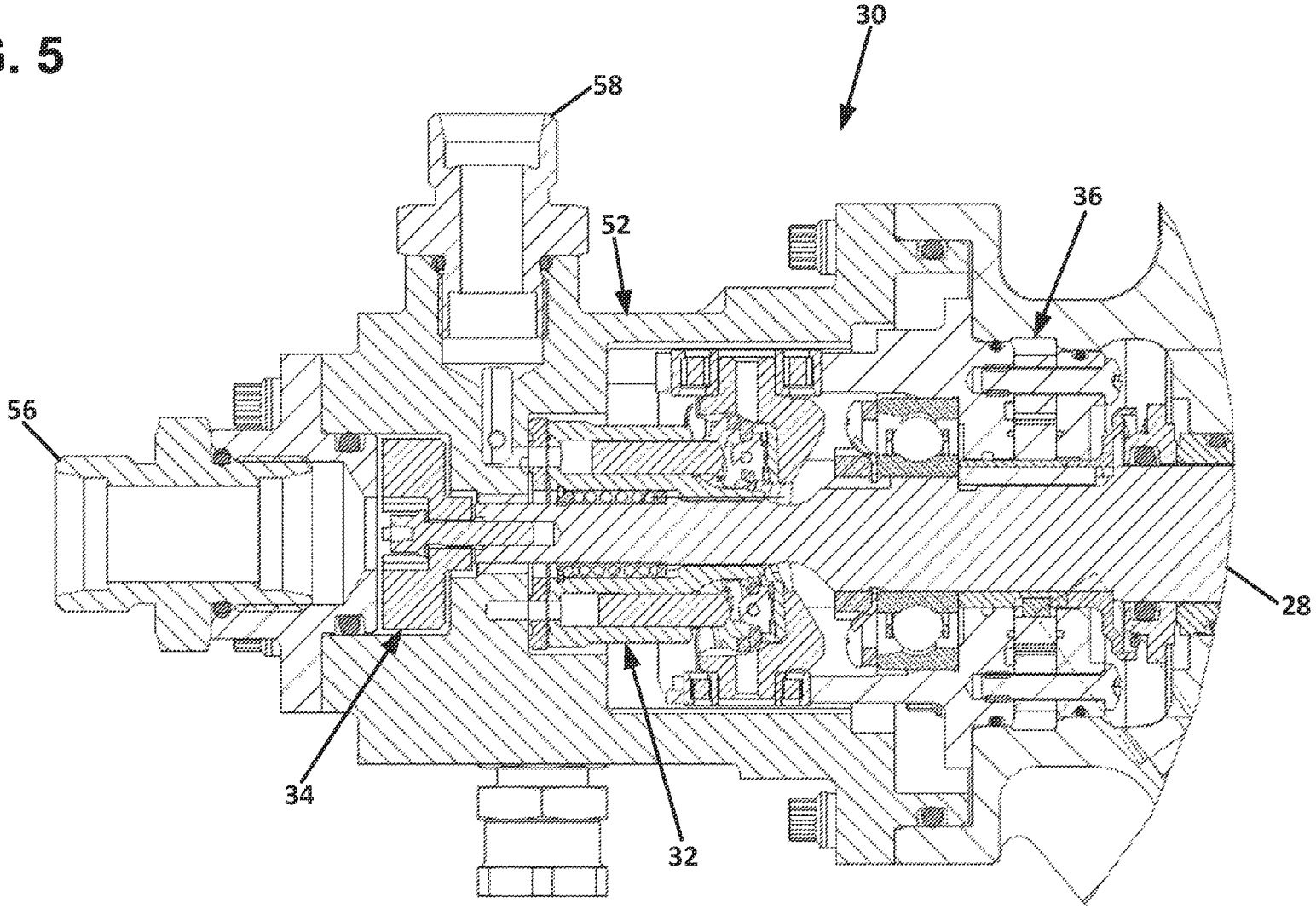
FIG. 5 is another cross-sectional view through the pump assembly of the electric motor driven pump arrangement of FIG. 3.
Figure 6:
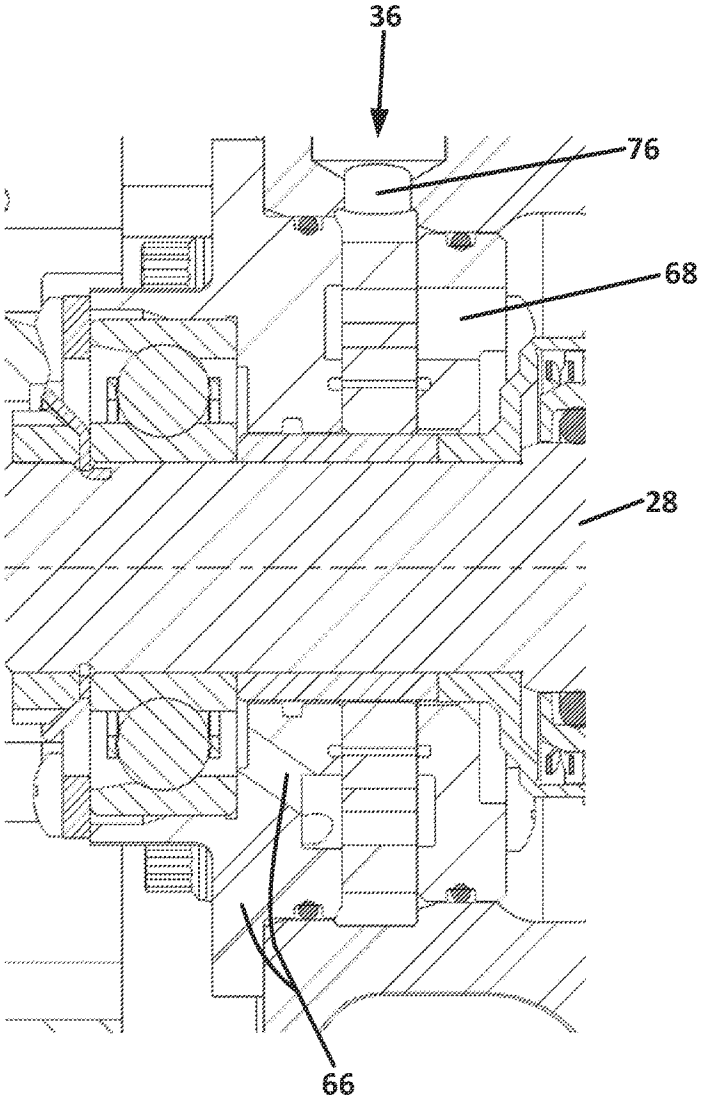
FIG. 6 is an enlarged view of a cooling flow pump that is part of the pump assembly of FIGS. 4 and 5.

FIGS. 4 and 5 are cross-sectional views that depict the pump assembly 30 within the pump case 52. As shown at FIGS. 4 and 5, the main hydraulic pump 32 is depicted as an axial-piston pump that includes a piston block 82 coupled to the output shaft 28 so as to rotate in unison with the output shaft 28 about the axis of rotation 29. The piston block 82 defines a plurality of cylinders 84 that receive pistons 86 such that the pistons 86 can reciprocate within the cylinders 84. The pistons 86 have heads coupled to hydrostatic shoes 88 that ride on a swash plate 90. The swash plate 90 can be pivoted relative to the axis of rotation 29 to vary the stroke lengths of the pistons 86 and thereby alter the displacement rate of the main hydraulic pump 32. The piston block 82 and cylinders 84 form part of the rotating group 38 of the min hydraulic pump 32.

Referring still to FIGS. 4 and 5, the suction boost pump 34 is depicted as a boost impeller coupled to the end of the output shaft 28 so as to rotate with the output shaft 28. As previously described, the suction boost pump 34 can include first and second outlets 44*a*, 44*b* positioned 180 degrees apart from one another. The first outlet 44*a* can be in fluid communication with inlet of the main hydraulic pump 32 and the interior of the pump case 52, while the second outlet 44*b* can be in fluid communication with the cooling loop 64.

Figure 7:
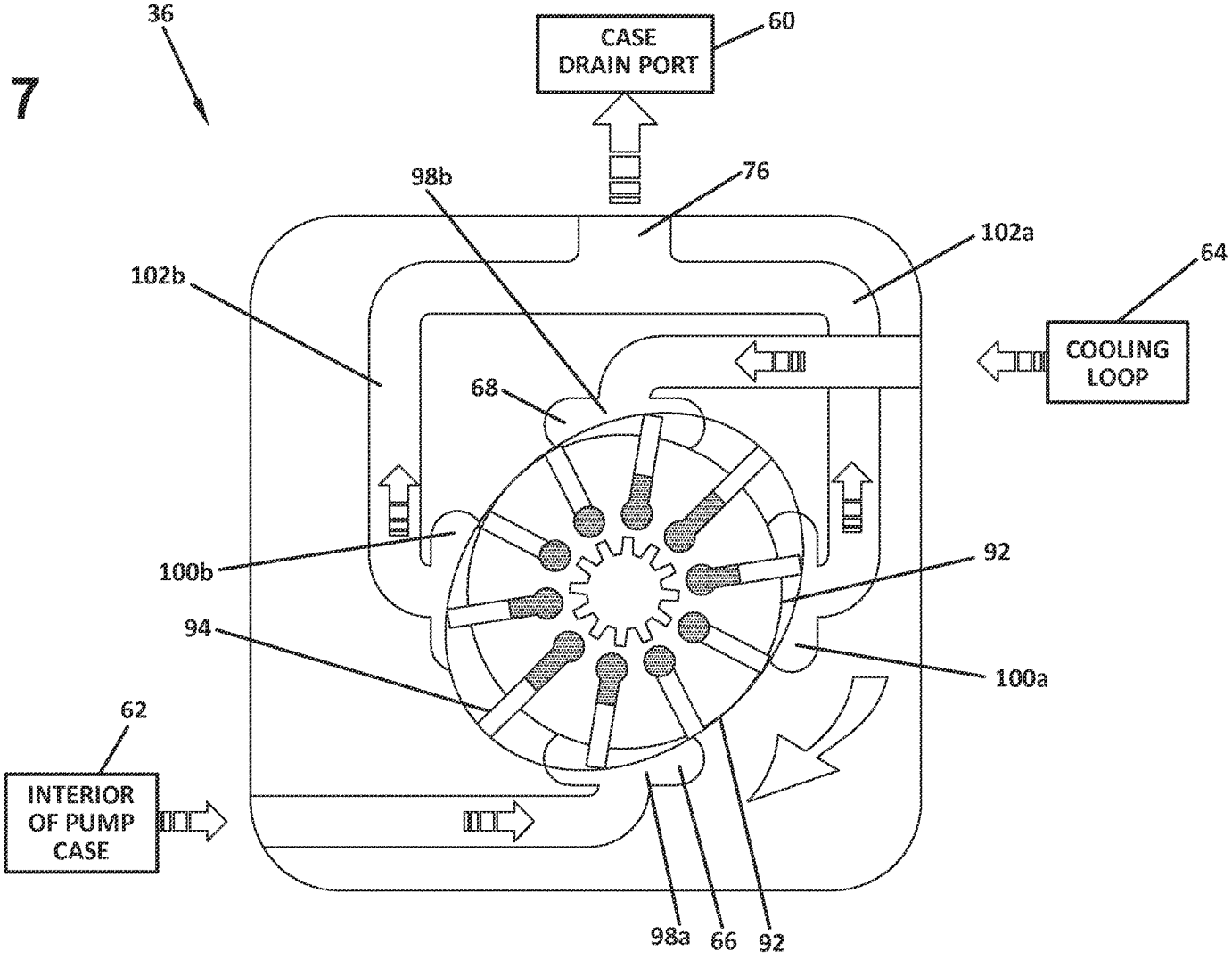
FIG. 7 is a schematic representation of the cooling flow pump of FIG. 6.
Figure 8:
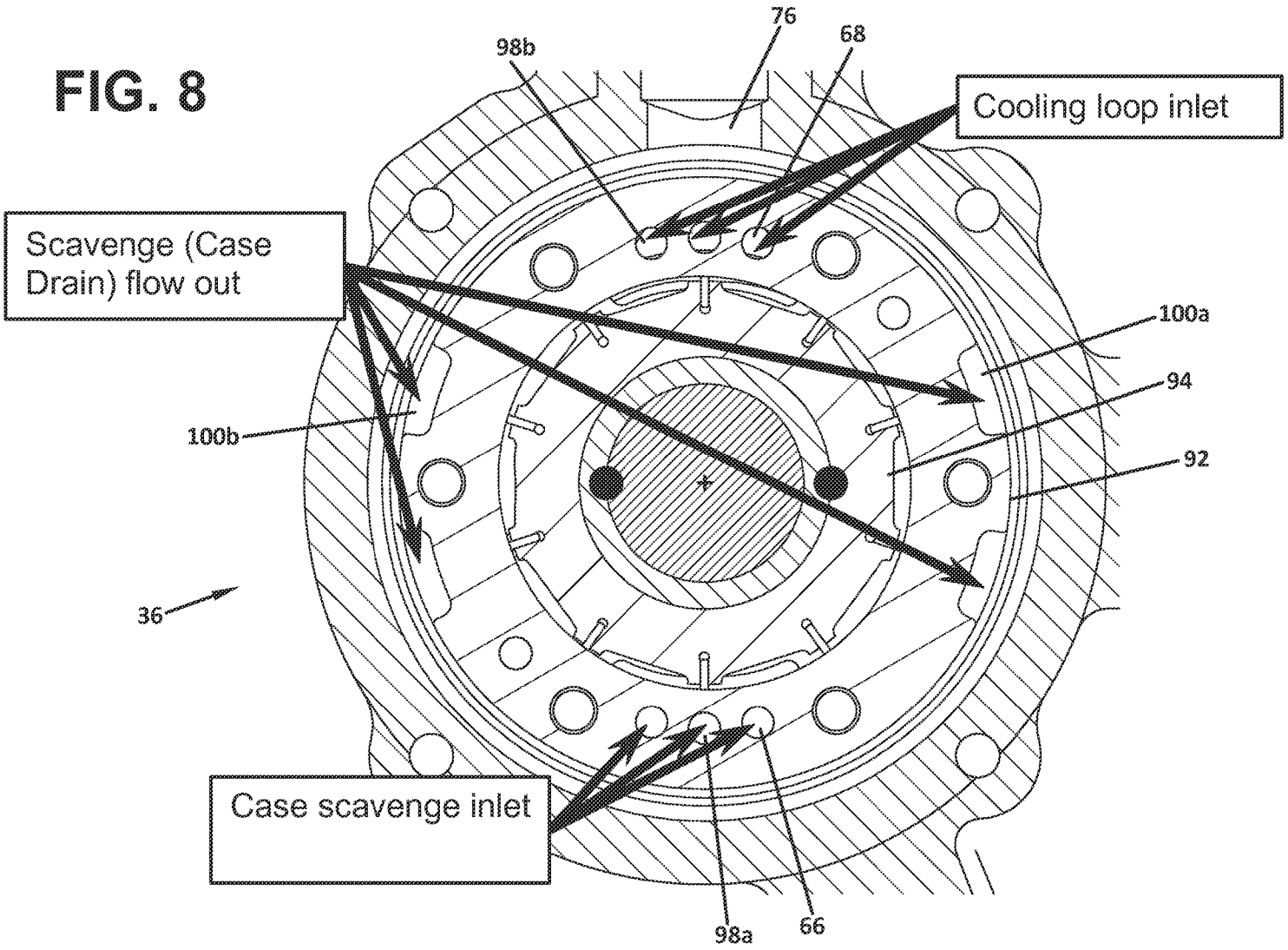
FIG. 8 is a crass-sectional view of the cooling flow pump of FIG. 6.
Figure 9:
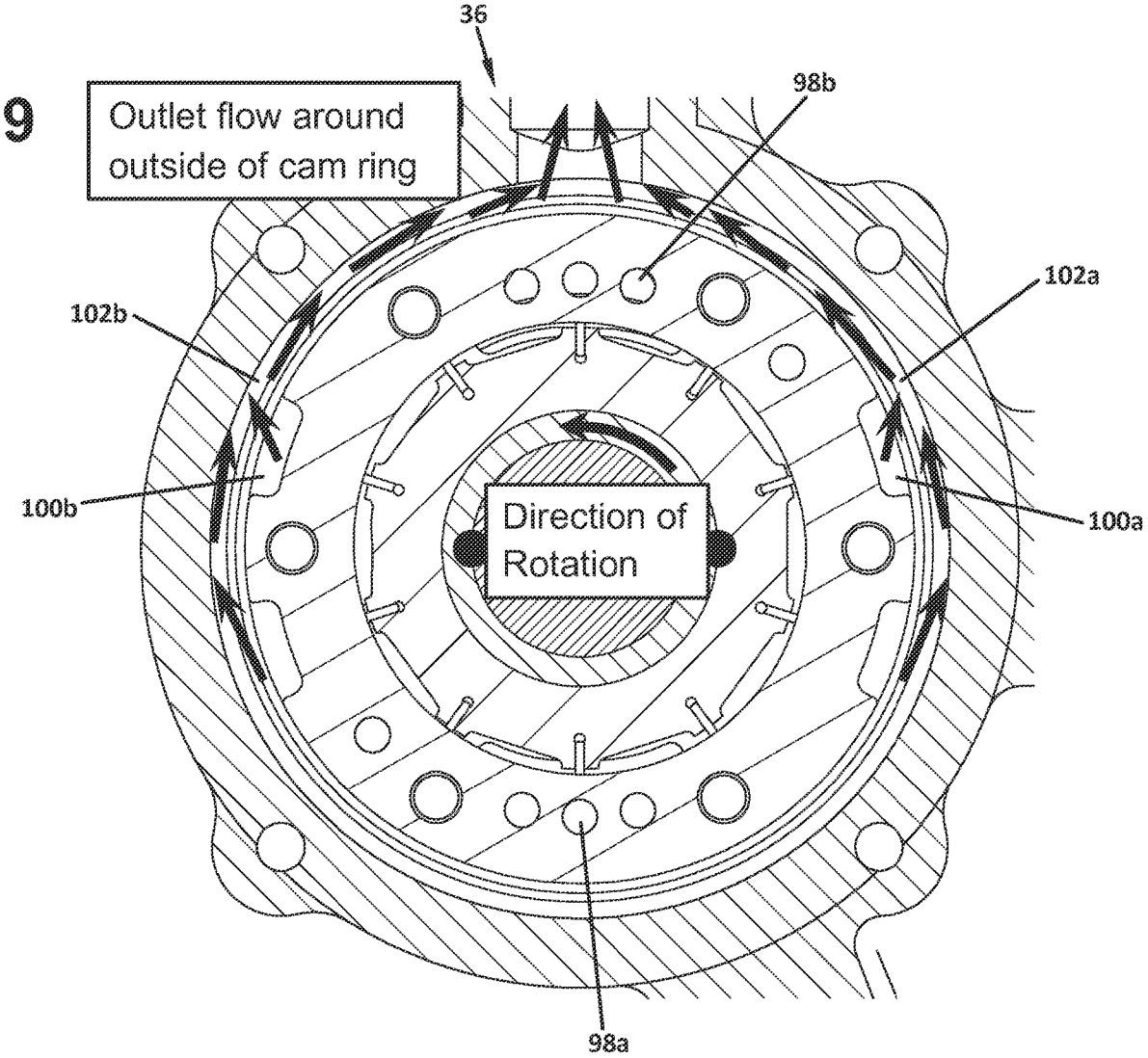
FIG. 9 is another cross-sectional view of the cooling flow pump of FIG. 6.

FIGS. 4 and 5 also show an example of the cooling flow pump 36. Specifically, FIGS. 4 and 5 show the cooling flow pump 36 as a radial vane pump. As previously described, the cooling flow pump includes a first inlet 66 (see FIG. 4) in fluid communication with the interior 62 of the pump case 52 and a second inlet 68 (see FIG. 4) in fluid communication with the cooling loop 64. Referring to FIGS. 7-9, the cooling flow pump 36 includes a rotor 92 that carries a plurality of vanes 94. The rotor 92 is coupled to the output shaft 28 such that the rotor 92 rotates with the output shaft 28 about the axis of rotation 29. In certain examples, rotor 92 can be keyed, splined or otherwise coupled to the output shaft 28. The rotor 92 rotates with the output shaft 28 relative to a cam ring 96 (e.g., a double throw cam ring). As the rotor 92 rotates, the vanes 94 move radially relative to the rotor 92 so as to follow the cam ring 96.

The depicted cooling flow pump 36 has a balance configuration with first and second inlet locations 98*a*, 98*b* and first and second outlet locations 100*a*, 100*b*. The inlet locations 98*a*, 98*b* are positioned 180 degrees apart and the output locations 100*a*, 100*b* are positioned 180 degrees apart. The input location 98*a* corresponds to the first inlet 66 of the cooling flow pump 36 and draws fluid from the interior 62 of the pump case 52. The inlet location 98*b* corresponds to the second inlet 68 of the cooling flow pump 36 and draws hydraulic fluid from the cooling loop 64. The output locations 100*a*, 100*b* are fluidly coupled to passages 102*a*, 102*b* that merge and combine the flow from the dual inlets before reaching the case drain port 60 such that the cooling flow pump 36 has only a single outlet port. In certain examples, the passages 102*a*. 102*b* can flow circumferentially around an exterior of the cam ring 96 as shown at FIG. 9.

In operation of the cooling flow pump 36, hydraulic fluid from the inlet locations 98*a*, 98*b* is drawn into pocket regions between the vanes 94 due to expansion of the volume defined by the pocket regions between the vanes 94. Expansion occurs as the vanes 94 follow the cam ring 92 and move radially out of the rotor 92. After the hydraulic fluid has been drawn into the pocket regions at the inlet locations 98*a*, 98*b*, interaction between the vanes 94 and cam ring 96 causes the vanes 90 to move radially into the rotor 92 thereby reducing the volumes of the pocket regions between the vanes 94. This reduction in volume causes the hydraulic fluid contained within the pocket regions to be pressurized and forced out the outlet locations 100*a*, 100*b*. The cyclical expansion and contraction of the volumes between the vanes 94 creates a pumping action that draws hydraulic fluid into the inlet 66, 68 and forces hydraulic fluid out the case drain port 60. In certain examples, inlet flow rates between the inlet locations can be varied by altering the displacement profiles on the double-throw cam ring.

Figure 10:
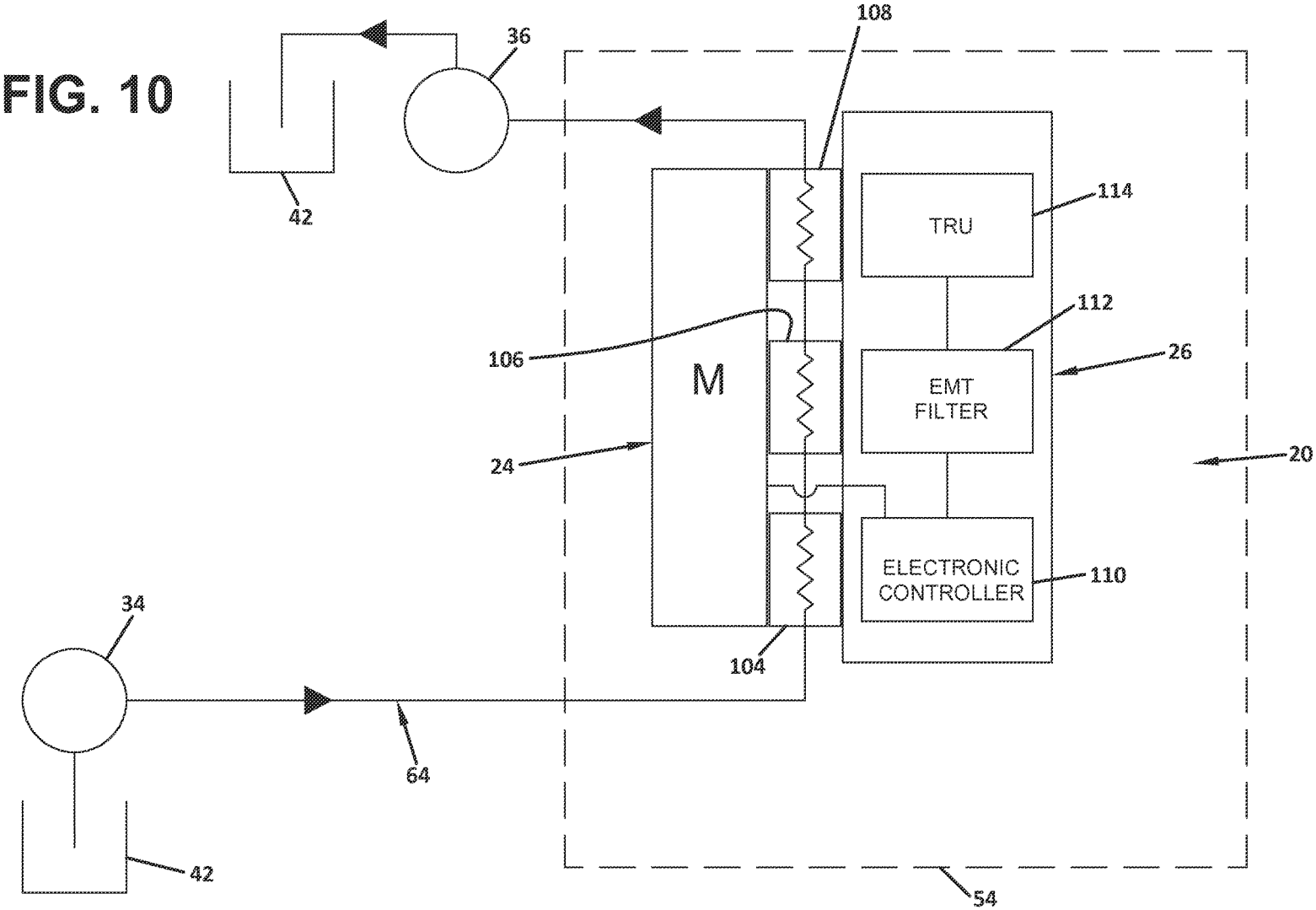
FIG. 10 schematically illustrates an example cooling circuit for cooling an electric motor and various motor control components of the electric motor driven pump arrangement of FIG. 3.

FIG. 10 is another schematic illustration of the cooling loop 64. As previously described, the cooling loop 64 extends from the suction boost pump 34, through the motor case 54 and then back to the cooling flow pump 36 which then directs the flow through the case drain port 60 to tank 42. As shown at FIG. 10, the electric motor system 20 includes the electric motor 24 and the control arrangement 26 which can be positioned within the motor case 54. Within the motor case 54, the cooling loop 60 can include a plurality of heat exchangers 104, 106, 108 for removing heat from the electric motor system 22. The heat exchangers 104, 106, 108 can include cooling plates in which the cooling loop 64 is routed in a serpentine or other convoluted path. The heat exchangers 104, 106, 108 can be positioned adjacent to various components of the control arrangement 26. For example, the heat exchangers 104, 106, 108 can respectively correspond to an electronic controller unit 110 including an arrangement of control circuitry, an electromagnetic interference filter unit 112 and a transformer rectification unit 114. The heat exchangers 104, 106, 108 can also be positioned adjacent to the electric motor 24 so as to remove heat generated by the motor shaft, the motor coils, the structure within the electric motor itself. More or fewer heat exchanges can be provided within the motor case 54 as needed.

Figure 11:
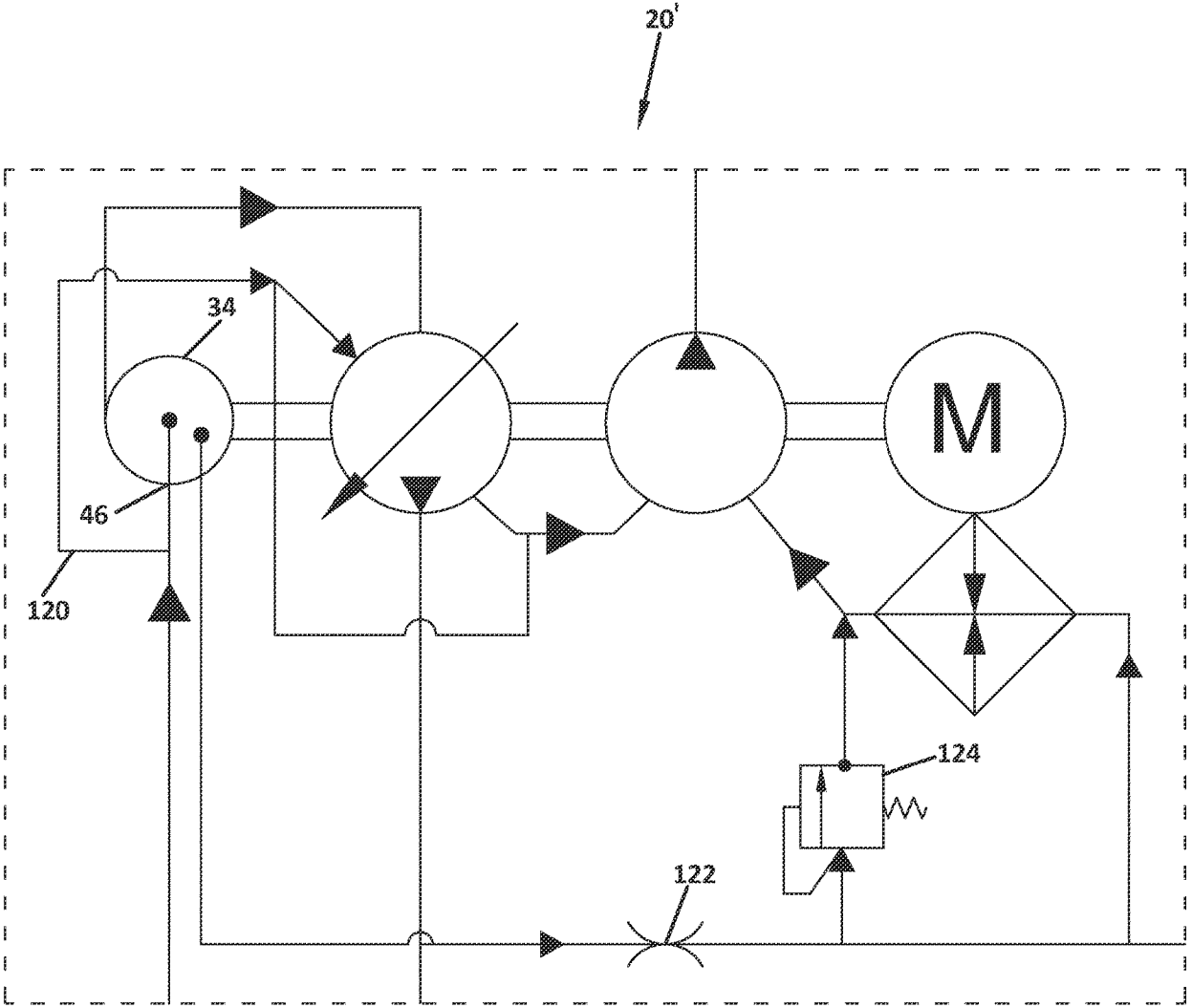
FIG. 11 schematically illustrates another electric motor driven pump arrangement in accordance with the principles of the present disclosure.

FIG. 11 shows another electric motor pump arrangement 20' in accordance with the principles of the present disclosure. The electric motor pump arrangement 20' has the same general configuration as the electric motor pump arrangement 20 except make-up hydraulic flow provided to the interior 62 of the pump case 52 is provided by a flow line 120 in fluid communication with the inlet 46 of the suction boost pump 34. Also, a flow restriction 122 (e.g., a fixed orifice) and a pressure-relief valve 124 are provided along the cooling loop.

It will be appreciated that the various operating environments depicted herein are exemplary and explanatory only and are not restrictive of the broad concepts upon which the examples disclosed herein are based.

What is claimed is:

1. An electric motor driven pump arrangement, comprising:

an electric motor system including an electric motor that drives rotation of an output shaft;

a main hydraulic pump driven by the electric motor though the output shaft to convert electrical power into hydraulic power;

a cooling flow pump driven by the electric motor through the output shaft;

a pump case enclosing the main hydraulic pump and the cooling flow pump; and the cooling flow pump having a first inlet in fluid communication with an interior of the pump case and a second inlet in fluid communication with a cooling flow path for cooling the electric motor system; and, a boost pump positioned within the pump case and driven by the output shaft, the boost pump having outlets in fluid communication with the cooling flow path and the main hydraulic pump.

2. The electric motor driven pump arrangement of claim 1, wherein the cooling flow pump has a single outlet.

3. The electric motor driven pump arrangement of claim 2, wherein the single outlet is in fluid communication with a case drain port of the pump case.

4. The electric motor driven pump arrangement of claim 1, wherein the cooling flow pump is a radial vane pump.

5. The electric motor driven pump arrangement of claim 1, wherein at least one of the outlets of the boost pump is in fluid communication with the interior of the pump case.

6. The electric motor driven pump arrangement of claim 1, wherein the main hydraulic pump is a variable displacement axial piston pump.

7. The electric motor driven pump arrangement of claim 5, wherein the boost pump is an impeller pump.

8. An electric motor driven pump arrangement, comprising:

an electric motor system including an electric motor that drives rotation of an output shaft;

a main hydraulic pump driven by the electric motor though the output shaft to convert electrical power into hydraulic power;

a cooling flow pump driven by the electric motor through the output shaft;

a pump case enclosing the main hydraulic pump and the cooling flow pump; and the cooling flow pump having a first inlet in fluid communication with an interior of the pump case and a second inlet in fluid communication with a cooling flow path for cooling the electric motor system; and, a boost pump positioned within the pump case and driven by the output shaft, the boost pump having outlets in fluid communication with the cooling flow path and the main hydraulic pump;

wherein the electric motor system is enclosed in a motor case, wherein the pump case is attached to the motor case, and wherein the cooling flow path is routed through the motor case;

wherein a portion of the cooling flow path is defined by a tube routed outside of the pump case and the motor case for carrying hydraulic fluid from the pump case to the motor case;

wherein the electric motor system includes an electronic controller for controlling operation of the electric motor, a transformer rectification unit and an electromagnetic interference filter unit positioned within the motor housing, and wherein the cooling flow path includes separate heat exchangers within the motor case including a first heat exchanger corresponding to the electronic controller, a second heat exchanger corresponding to the transformer rectification unit and a third heat exchanger corresponding to the electromagnetic interference filter unit.

9. The electric motor driven pump arrangement of claim 8, wherein the the first an second heat exchangers include cooling plates.

10. The electric motor driven pump arrangement of claim 9, wherein the cooling flow path is routed in convoluted patterns through the cooling plates.

11. The electric motor driven pump arrangement of claim 8, wherein the first heat exchanger is positioned adjacent to the electronic controller for cooling the electronic controller.

12. A method for cooling an electric motor driven pump arrangement that includes an electric motor system that drives an output shaft and a main hydraulic pump driven by the output shaft, the method comprising:

scavenging energy from the output shaft to drive a multi-inlet cooling flow pump having a first inlet in fluid communication with a pump case that houses the main hydraulic pump, the multi-inlet cooling flow pump also including a second inlet in fluid communication with a cooling flow path routed through a motor case that houses the electric motor system;

operating a boost pump positioned within the pump case and driven by the output shaft to boost flow in the cooling flow path, wherein the boost pump has outlets in fluid communication with the cooling flow path and the main hydraulic pump.

* * * * *